United States Patent [19]

Paban

[11] 4,261,670

[45] Apr. 14, 1981

[54] PROCESS FOR THE PROTECTION OF GALLERIES

[76] Inventor: Rolland Paban, Soissons S, Nacey-21, France

[21] Appl. No.: 16,803

[22] Filed: Mar. 2, 1979

Related U.S. Application Data

[63] Continuation-in-part of Ser. No. 867,275, Jan. 5, 1978.

[51] Int. Cl.[3] ..... E21D 11/00

[52] U.S. Cl. ..... 405/150; 405/132; 427/136

[58] Field of Search ..... 405/150, 151, 132; 427/136, 236, 388 B; 239/422, 336

[56] References Cited

U.S. PATENT DOCUMENTS

| | | | |
|---|---|---|---|
| 3,659,790 | 5/1972 | Gelin | 239/336 |
| 3,850,661 | 11/1974 | Dreher et al. | 427/136 |
| 3,908,049 | 9/1975 | Fitko | 427/236 X |
| 3,912,790 | 10/1975 | Chang et al. | 260/849 |
| 3,960,983 | 6/1976 | Blank | 427/388 X |
| 3,971,223 | 7/1976 | Barrett | 427/136 X |
| 4,053,682 | 10/1977 | Donermeyer | 427/388 B X |

FOREIGN PATENT DOCUMENTS

| | | | |
|---|---|---|---|
| 1965815 | 7/1971 | Fed. Rep. of Germany | 405/150 |

OTHER PUBLICATIONS

M-S-A Rigiseal Publication, printed 1/63.

*Primary Examiner*—Dennis L. Taylor
*Attorney, Agent, or Firm*—Gifford, VanOphem, Sheridan & Sprinkle

[57] ABSTRACT

A process for the protection of the surface of the terrain in mine galleries from deterioration due to the surrounding atmosphere is characterized by the operation of spraying onto the wall to be protected, a fluid mixture of aminoplast resin powder and water and leaving the resin to gel on the spot, thus forming a continuous insulating lining coating.

3 Claims, No Drawings

PROCESS FOR THE PROTECTION OF GALLERIES

CROSS REFERENCE

This application is a continuation-in-part of my copending U.S. patent application Ser. No. 867,275 filed on Jan. 5, 1978.

BACKGROUND OF THE INVENTION

I. Field of the Invention

This invention relates to sealing of mine galleries and materials therefore.

II. Description of the Prior Art

Systems are known in which certain mine galleries are protected and consolidated, particularly in certain zones in which the nature of the terrain is liable to jeopardize the stability of the galleries.

The processes recommended for this purpose make use of a lining produced by sprayed concrete, a more rapid and less expensive process than the use of coffered concrete. This technique nevertheless calls for a relatively large number of operators, working under arduous conditions, and involving comparatively lengthy periods when the mine working is shut down.

SUMMARY OF THE INVENTION

The present invention provides a fresh solution to this problem in cases where all that is required is to protect the terrain from deterioration due to the surrounding atmosphere, without any attempt to provide a supporting system.

For example, the material uncovered or cut is very easily liable to crumble as a result of the combined action of air and moisture, and it is important to protect it with an inexpensive lining easy to apply without attempting to give it supporting properties likewise.

According to the invention, a lining of this kind is applied by a process consisting of the operation of spraying onto the wall to be protected a fluid mixture of aminoplast resin powder and water and of leaving the resin to gel on the spot, thus forming a continuous insulating lining coating.

In practice, the process consists of the application of a number of superimposed coatings, at least the central coating containing a certain proportion of glass fibers sprayed at the same time as the resin.

The invention thus aims at a new application for aminoplast resins, i.e., their application to the technique of providing insulating linings for walls of mine galleries, and at the practical conditions required for this application.

It should be noted that aminoplast resins, widely used in the technique of adhesives, have already been suggested for the reinforcement of terrains, but by injection into the cracks and not by their application as linings. A technique of this kind is costly and uncertain, as it involves the injection of large quantities of resin at random, its distribution in the cracks in the terrain being uncertain and hypothetical. In the technique covered by the invention, on the other hand, the resin is applied under precise and well defined conditions which can be adjusted by the operator as desired.

It is true, moreover, that consideration has been given to the use of polyester resins for the same purpose, but these resins are dangerous and inconvenient, being on the one hand toxic and inflammable and on the other hand very difficult to clean with organic solvents.

Aminoplast resins usable in the process of the present invention include the polycondensation resins of melamine and formol; the polycondensation resins of melamine, urea, and formol; and the polycondensation resins of melamine phenol, and formol. Of course, it should be understood that other aminoplast resins with similar properties and constructions are also usable in the invention. The specific examples given above are especially adapted for use in the present process since they are sold in pulverulent form.

Aminoplast resins, on the other hand, are not flammable, and the installation is easy to wash with water.

Finally, experience shows that the cost of a lining of this kind is lower and that the system calls for a number of operators and is more rapid than the techniques adopted at present.

DESCRIPTION OF THE PREFERRED EMBODIMENT

By way of example, the conditions of application forming the basis of a test carried out for the technique covered by the invention will now be described below.

The technique being a new one, the apparatus for its application was provided on the basis of equipment so far available on the market, and a more thorough study of the matter can be made later on. The first requirement was to ascertain the behavior of the lining over a given period of time and under the conditions prevailing in the mine.

1. Delivery pump.

Type: REXON, operated by compressed air, double-acting plunger piston.

Delivery: 200–250 l/h

Pressure: 48 bar.

2. Spray gun.

This is a gun of the type used, for example, for the spraying of polyester resin in the manufacture of hulls for vessels.

This gun is fitted with a rotating knife having a number of blades and serving to cut the cord of glass fiber. The number of blades governs the length of the fibers sprayed in front of the jet of resin.

3. Compressed air.

A delivery of 5 $m^3$/min is required, with a pressure of 6–7 bar, to actuate the pump and feed the gun.

4. Water.

A reserve water supply of 500 liters is sufficient.

5. Mixer.

The resin and water must be very carefully mixed.

The mixer is a screw affixed to the cover of the powder conditioning drum. This screw is actuated by an air drill.

6. Miscellaneous equipment.

Spare parts must be available, in order to enable action to be taken more quickly in the event of a stoppage: nozzles, gun nozzles, pump suction filters.

7. Personnel.

One spray operator.

Two assistants for the preparation of a mixture, the handling operation and the various services required in the event of faulty operation.

There is no doubt that when more advanced equipment has been designed, enabling the handling operations to be mechanized, one sprayer and one assistant should prove sufficient.

8. Products and dosages.

Resin: aminoplast, in powder form, as one single constituent. The aminoplast resin used in this example was a melamine/formol polycondensation resin sold by the company C.I.B.A. under the trademark "MELOCOL FFD".

This is delivered in metal drums containing two bags of 12.5 kg, i.e., 25 kg per drum.

It is mixed with water at the rate of 80% by weight of resin to 20% by weight of water, giving a viscosity of 67 poise.

Under these conditions the gelatinization time is 40 minutes and the sample required is extracted between 1 and ½ hours after it has been mixed.

Glass fiber: known as "roving," supplied in the form of a cord of 6 mm in diameter, in 18 kg coils, in a cardboard box.

The roving will be used at the rate of 5–10% by weight in relation to the resin powder.

The optimum proportion will in each case depend on the quality criteria for the finished lining, these being adhesion to the rock, compactness and continuity, where its strength is concerned, and hermeticity where its anti-moisture protective action is concerned.

9. Performance of process.

The arched roof to be treated is bolted in the normal operating cycle.

The cleansing must be carried out with care. The surface is washed, if necessary, with the use of a spray gun. The mixture of water and powdered resin is produced by means of a mixer, in two lots of 25 kg of resin powder. This mixing operation must be carefully performed, in order to ensure a homogeneous mixture.

The drum containing this mixture is placed underneath the delivery pump, the suction tube being intended to effect complete suction. A very fine filter is indispensable for this suction operation, in order to avoid obstructions. This filter must be frequently washed; it is desirable to have a number of filters in readiness in order not to have to interrupt the spraying program.

The liquid resin is thus forced as far as the spray gun, by which it is sprayed onto the wall to be treated. The compressed air reaching the gun also serves to turn the knife and spray the particles of fiber in front of the jet of resin. The results obtained in these tests were as follows:

Cost price: 50.14 frs per $m^2$ of lining, made up of 8.75 for labor and 41.41 for supplies.

This result should be compared with the cost price of a lining of sprayed concrete, i.e., 79.49 frs. per $m^2$(50.40 for labor and 29.09 for supplies).

Furthermore, it may be added, from a technical point of view, that this method is quicker to apply than the sprayed concrete method, the site being immobilized for a 4–5 times shorter period and only two men being required in place of 6;

the spraying operation itself is less arduous than the spraying of concrete, the latter operation involving the creation of dust;

the touching-up operations required on the lining can be effected with ease;

the equipment occupies less space.

In addition to the application which has just been described, the invention can be used for other similar purposes: the construction of dams, ventilation, repair of existing dams, sealing of cracks, air-tight and water-tight coatings, etc.

Therefore, what is claimed is:

1. A process for the protection of the surface of the terrain in mine galleries from deterioration due to the surrounding atmosphere, comprising the steps of:

(a) cleaning the surface to be protected by spraying with water;

(b) spraying onto the wall to be protected a homogeneous fluid mixture of aminoplast resin power and water so as to form a substantially moisture proof, air-tight, continuous lining; and (c) leaving the resin to gel on the spot, thus forming a continuous insulating lining coating.

2. A process in accordance with claim 1, further comprising the application of a number of successive coatings wherein, at least one coating contains a charge of glass fibers.

3. A process in accordance with claim 2, comprising the application of a first priming coating without glass fiber, followed by a coating with a charge of glass fibers, and finally by a sealing coating with only a very small quantity of glass fiber.

* * * * *

UNITED STATES PATENT AND TRADEMARK OFFICE

CERTIFICATE OF CORRECTION

PATENT NO. : 4,261,670

DATED : April 14, 1981

INVENTOR(S) : Rolland Paban

It is certified that error appears in the above–identified patent and that said Letters Patent are hereby corrected as shown below:

Column 4, line 32, delete "power" and insert --powder-- therefor.

Signed and Sealed this

*Seventh* Day of *July 1981*

[SEAL]

*Attest:*

RENE D. TEGTMEYER

*Attesting Officer*

*Acting Commissioner of Patents and Trademarks*